US011004624B2

(12) United States Patent
Riepe et al.

(10) Patent No.: US 11,004,624 B2
(45) Date of Patent: May 11, 2021

(54) CIRCUIT BREAKER LOCKOUT APPARATUS

(71) Applicant: ABUS August Bremicker Söhne KG, Wetter-Volmarstein (DE)

(72) Inventors: Bettina Riepe, Wuppertal (DE); Manuel Cornelius Neveling, Wetter (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 16/425,272

(22) Filed: May 29, 2019

(65) Prior Publication Data

US 2019/0371541 A1 Dec. 5, 2019

(30) Foreign Application Priority Data

May 30, 2018 (DE) ..... 102018113009.0

(51) Int. Cl.
*H01H 9/28* (2006.01)
*H01H 71/12* (2006.01)

(52) U.S. Cl.
CPC ..... *H01H 9/283* (2013.01); *H01H 71/12* (2013.01)

(58) Field of Classification Search
CPC ..... H01H 9/283; H01H 71/12
USPC ..... 200/512, 43.15; 29/622
See application file for complete search history.

(56) References Cited

U.S. PATENT DOCUMENTS

| | | | | |
|---|---|---|---|---|
| 5,500,495 | A | 3/1996 | Benda et al. | |
| 7,977,590 | B2 | 7/2011 | Brojanac | |
| 8,847,086 | B2 | 9/2014 | Wojtak | |
| 8,890,010 | B2 | 11/2014 | Montgomery et al. | |
| 9,208,964 | B2 | 12/2015 | Dudgeon et al. | |
| 2008/0067043 | A1 | 3/2008 | Brojanac | |
| 2009/0038920 | A1* | 2/2009 | Hammermayer | H01H 71/0264 200/293 |
| 2014/0165384 | A1* | 6/2014 | Dudgeon | H01H 9/283 29/622 |
| 2014/0250955 | A1 | 9/2014 | Miller et al. | |

FOREIGN PATENT DOCUMENTS

| | | | |
|---|---|---|---|
| CA | 2 538 584 | A1 | 11/2006 |
| CA | 2 577 167 | A1 | 8/2008 |
| CA | 2 809 583 | A1 | 3/2012 |
| CA | 2 816 140 | A1 | 5/2012 |

(Continued)

*Primary Examiner* — Edwin A. Leon
*Assistant Examiner* — Iman Malakooti
(74) *Attorney, Agent, or Firm* — Dinsmore & Shohl LLP

(57) ABSTRACT

A circuit breaker lockout apparatus includes a base body having a first section, a second section, and a recess formed between the first and second sections to receive a switch lever of a circuit breaker; a fixing element installed at the first section of the base body and having an actuation section to fix the base body to a switch lever of a circuit breaker received in the recess; and a cover adjustably fastened between a release position and a lockout position at the base body, the actuation section of the fixing element is accessible in the release position and is covered in an inaccessible manner by the cover in the lockout position, and the cover is configured to be fixed to the base body in the lockout position to block an adjustment of the cover from the lockout position into the release position.

20 Claims, 4 Drawing Sheets

(56) References Cited

FOREIGN PATENT DOCUMENTS

| | | | | | |
|---|---|---|---|---|---|
| CA | 2 833 617 | A1 | | 11/2012 | |
| MX | 2015004429 | A | | 6/2015 | |
| WO | 2006/105288 | A2 | | 10/2006 | |
| WO | WO2006105288 | | * | 10/2006 | ..... H01H 9/28 |

* cited by examiner

CIRCUIT BREAKER LOCKOUT APPARATUS

CROSS-REFERENCE TO RELATED APPLICATIONS

The present disclosure claims priority to German Patent Application No. DE 102018113009.0 filed May 30, 2018, the contents of which are incorporated by reference herein.

TECHNICAL FIELD

The present disclosure relates to a circuit breaker lockout apparatus, in particular to a power circuit breaker lockout apparatus, comprising a base body having a first section, a second section, and a recess formed between the first and second sections to receive a switch lever, in particular a toggle switch lever, of a circuit breaker, in particular a power circuit breaker; a fixing element, in particular a locking screw, installed at the first section of the base body and having an actuation section to fix the base body to a switch lever of a circuit breaker received in the recess; and a cover adjustably fastened between a release position and a lockout position at the base body, wherein the actuation section of the fixing element is accessible for an actuation in the release position and is covered in an inaccessible manner by the cover in the lock-out position, and wherein the cover is configured to be fixed to the base body in the lockout position by a locking element, in particular a hoop of a padlock, to block an adjustment of the cover rom the lockout position into the release position.

BACKGROUND

A switch lever of a circuit breaker, in particular of a power circuit breaker that is located in its position, in particular its toggled position, switching off the electric circuit to be secured, can be locked out or secured by one person against an actuation by a third person through such a circuit breaker lockout apparatus to be able to carry out work at the electric circuit without risk, i.e. without being in danger that the electric circuit is activated again by a different person, accidentally or from a lack of knowledge of the ongoing work. The switch lever of the circuit breaker is received in the recess of the base body of the circuit breaker lockout apparatus for this purpose and the base body is subsequently fixed at the switch lever or at the circuit breaker by the fixing element. The cover is then adjusted into its lockout position so that the actuation section of the fixing element is no longer accessible. Finally, the cover is fixed at the base body a locking element, in particular a padlock or a hoop of a padlock, in the lockout position to block an adjustment of the cover from the lockout position for so long until the padlock has been removed again.

Such a circuit breaker lockout apparatus is known from U.S. Pat. No. 9,208,964 B2. The fixing of the cover to the base body in the lockout position in this document comprise two conduits that extend through the base body and that each have two openings that are aligned with corresponding apertures in the cover in the lockout position of the cover. In a position of use of this circuit breaker lockout apparatus, the one of the two conduits extends horizontally between two lateral sides of the base body and the other one of the two conduits extends transversely, from a side of the base body disposed opposite the recess to a lower side of the base body, such that a padlock can be hung in either in a horizontal position or in a vertical position, i.e. hanging downwardly, in the lockout position of the cover.

On a horizontal hanging in, the padlock takes up a lot of space in the horizontal direction, however, so that on the presence of a plurality of circuit breakers that are arranged directly next to one another, the attachment of the padlock is made more difficult by the adjacent circuit breakers and due to a lack of space possibly at least not all of the circuit breakers can be provided with such a circuit breaker lockout apparatus. On a vertical hanging in, the hoop of the padlock has to be threaded in a comparatively laborious manner into the corresponding passage. In another respect, the operation of such a circuit breaker lockout apparatus is not intuitively obvious to the user, neither for a horizontal hanging in nor for a vertical hanging in of a padlock.

It is therefore in particular the underlying object of the present disclosure to provide a circuit breaker lockout apparatus of the initially named kind that facilitates the attachment of a padlock and enables an intuitive operation.

SUMMARY

This object is satisfied by a circuit breaker lockout apparatus having the features of the present disclosure, and in particular in that the base body has a projection at a side disposed opposite the recess, the projection of the base body engaging through a cutout, in particular a rectangular cutout, formed in the cover from the inner side of the cover toward the outer side of the cover in the lockout position, with the projection being provided at the outer side of the cover with at least one passage through which a locking element can be led, in particular in each case.

In accordance with the present disclosure, the projection of the base body having the at least one passage engages outwardly through the cover so that the at least one passage is particularly easily accessible and a locking element can be led through particularly simply or a padlock can be hung in particularly simply. Since the at least one passage is relocated away from the recess, there is also sufficient spatial distance from the respective circuit breaker on the hanging in of a padlock so that an impediment-free hanging in is possible.

The projection can in particular be kept particularly compact so that a passage oriented horizontally in a position of use of the circuit breaker lockout apparatus can be kept particularly short so that a padlock can also be hung in hanging down with a horizontal passage, with the consequence that more room for a separate circuit breaker lockout apparatus is also available for an adjacent circuit breaker. If, alternatively or additionally, a vertically oriented passage is provided, a locking element, in particular a padlock, does not have to be laboriously threaded into it.

Furthermore, a padlock hung into a vertically oriented passage can be rotated toward both sides in the hung in state in order, for example, to be able to directly read an engraving on the lock body of the padlock that e.g. permits a conclusion on the owner of the padlock, i.e. on the person that has carried out the lockout of the circuit breaker. Such a hung in padlock can therefore in particular also be turned away to provide space if access is needed to an adjacent circuit breaker, in particular to also place a circuit breaker lockout apparatus there.

In addition, it immediately becomes clear to the user from the arrangement of the at least one passage outside the cover where the locking element has to be led through. It can in particular be easily recognized with a plurality of passages that a plurality of hang in variants are possible for a padlock, for example horizontally or vertically. The circuit breaker lockout apparatus in accordance with the present disclosure is therefore also particularly intuitively operable.

As already indicated above, provision can be made that the at least one passage is oriented horizontally, i.e. in particular from a first lateral side to a second lateral side of the projection, and/or vertically, i.e. in particular from an upper side to a lower side of the projection, in a position of use of the circuit breaker lockout apparatus in which the first section of the base body is upwardly oriented. A horizontal passage suggests itself, for example, if a reading of an engraving on the lock body should be possible without a rotation of the padlock used. If a plurality of circuit breakers that should each be provided with a circuit breaker lockout apparatus are provided arranged directly next to one another, vertical passages suggest themselves to enable an impediment-free hanging in of the padlocks next to one another.

A locking element can be a padlock, in particular a hoop of a padlock, with the hoop being able to be configured as rigid or flexible, in particular as a cable hoop. Furthermore, a locking element can also be configured as a cable lock having a cable, with it in particular also being possible that the one cable is led through the passages of a plurality of circuit breaker lockout apparatus so that a plurality of circuit breaker lockout apparatus can simultaneously be secured by one single cable lock.

In some embodiments, the at least one passage comprises a first passage and a second passage so that the user has a plurality of variants available to orient a locking element to be used to fix the cover to the base body relative to the circuit breaker lockout apparatus. The first passage and the second passage can in particular be a horizontal passage and a vertical passage such as have been described above, or conversely. It is generally conceivable that more than two passages are provided.

It is advantageous in the sense of a compact configuration of the projection or of the circuit breaker lockout apparatus if the first passage and the second passage intersect since in this case as little space as possible is taken up by the two passages.

Provision can in particular also be made that the diameter of the first passage, for example the horizontal or vertical passage, is smaller than the diameter of the second passage, for example the vertical or horizontal passage. It can be achieved by the provision of diameters of different sizes for the two passages that only specific padlock types can be used for the passage having the smaller diameter—namely dependent on the thickness of the hoop of the respective padlock. The diameter of the first passage and the diameter of the second passage can, however, also be identical.

In some embodiments, an edge of the projection formed at an end directed upwardly in the aforesaid position of use of the circuit breaker lockout apparatus and at a side remote from the recess has a chamfer that, in the region of the chamfer, extends up to and into the vertically oriented passage such that a section of an opening margin of the vertically oriented passage is formed that defines a plane that is inclined against the horizontal.

The opening margin of the vertically oriented passage thus forms a receiver, in particular a rounded receiver, for the hoop of a padlock in the region of the chamfer. A padlock can hereby hang in a defined position in the vertically oriented passage, which is in particular of advantage with a plurality of padlocks hanging next to one another. This applies the more since a hoop of a padlock is typically configured as a round hoop and can be received in a particularly stable position in a rounded receiver. To facilitate a lateral rotation of a vertically hung in padlock, the padlock can be slightly raised prior to the rotation.

The first section of the base body can furthermore have a blockade section that shields the actuation section of the fixing element against access from the recess side or against access at the recess side. Access from the otherwise open sides is shielded by adjusting the cover into its lockout position. Provision can, however, generally also be made that the cover is configured such that it also shields access at the recess side in its lockout position.

The cover can comprise at least one rear wall associated with the side of the base body disposed opposite the recess, an end face wall associated with the first section of the base body, and two mutually oppositely disposed side walls to cover the actuation section of the fixing element in an inaccessible manner in the lockout position. It can hereby be ensured in a simple manner that the actuation section of the fixing element is covered in a manner inaccessible from the outside in the lockout position of the cover. In some embodiments, the cutout is provided in the rear wall of the cover.

In accordance with an embodiment of the present disclosure, the adjustable fastening of the cover to the base body comprises the cover being pivotably fastened via a pivot device to the base body, in particular to the second section of the base body, between the release position and the lockout position. Such a fastening can be implemented particularly simply, in particular in connection with the engaging of the projection through the cutout formed in the cover. In some embodiments, the cover is pivotable over a pivot range of at least 45°, in particular of at least 90°.

The pivot device can here comprise the cover having a respective opening in the two aforesaid mutually oppositely disposed side walls and the second section of the base body having a respective pin at two mutually oppositely disposed lateral sides, the pin engaging, in particularly being latched, into a respective one of the two openings.

To enable a pushing of the cover onto the base body, in particular a movement of the respective pin up to the respective opening, on the assembly of the circuit breaker lockout apparatus, the respective side wall of the cover can have a groove-like depression at its inner side whose one end opens into the respective opening and whose other end extends up to a margin of the respective side wall. The two depressions in particular extend in parallel with one another and at the same level. The two pins can each have a run-on slope for the side walls of the cover to facilitate a pushing of the cover onto the base body.

The two pins can e.g. each be configured as being able to be pushed back. If the two pins pushed back on a pushing on of the cover are moved in up to the openings at the end of the push-on process, they can move out again there to latch into the openings. In accordance with another embodiment, the two pins are, however, configured as unmovable and the two side walls of the cover can be pressed apart from one another. In some embodiments, at least the two side walls of the cover are formed as spring elastic to enable a pressing apart of the two side walls on a pushing of the cover onto the base body.

In some embodiments, the base body and/or the cover is/are, in particular respectively, configured as an injection molded part and/or in one piece so that the circuit breaker lockout apparatus or its parts can be manufactured particularly simply. Complex forms can furthermore also be produced without problem using an injection molding process.

BRIEF DESCRIPTION OF THE DRAWINGS

Further advantageous embodiments of the present disclosure are described in the dependent claims, in the description of the Figures, and in the drawing.

The present disclosure will be described in the following by way of example with reference to the drawing. There are shown FIG. 1 a power circuit breaker lockout device in accordance with the present disclosure having a base body with a projection and a cover in a release position.

DETAILED DESCRIPTION

Figure 3:
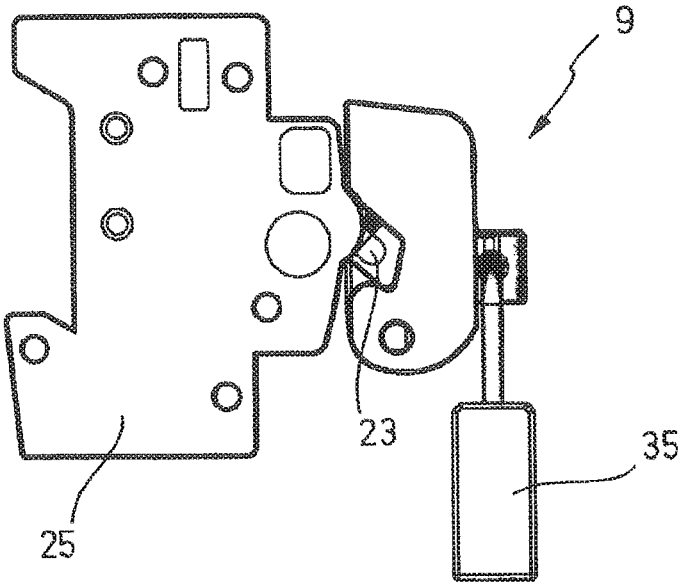
FIG. 3 a power circuit breaker with the power circuit breaker lockout apparatus in accordance with FIG. 2 and with a padlock hung in the first passage.
Figure 4:
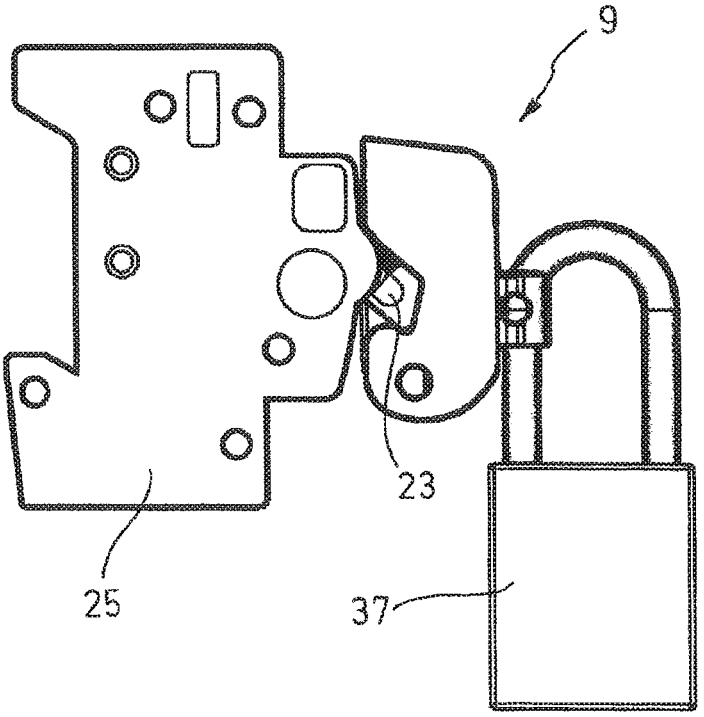
FIG. 4 a power circuit breaker with the power circuit breaker lockout apparatus in accordance with FIG. 2 and with a padlock hung in a second passage.

The power circuit breaker lockout apparatus 9 shown in the Figures can be fastened to a toggle switch lever 23 of a power circuit breaker 25 to prevent an actuation of the toggle switch lever 23 (cf. FIGS. 3 and 4). This is in particular necessary when work is carried out at an electric circuit by a person and the electric circuit is switched off for this purpose by an associated power circuit breaker and an accidental switching on of the power circuit breaker 25 by a third person should be prevented.

Figure 1:
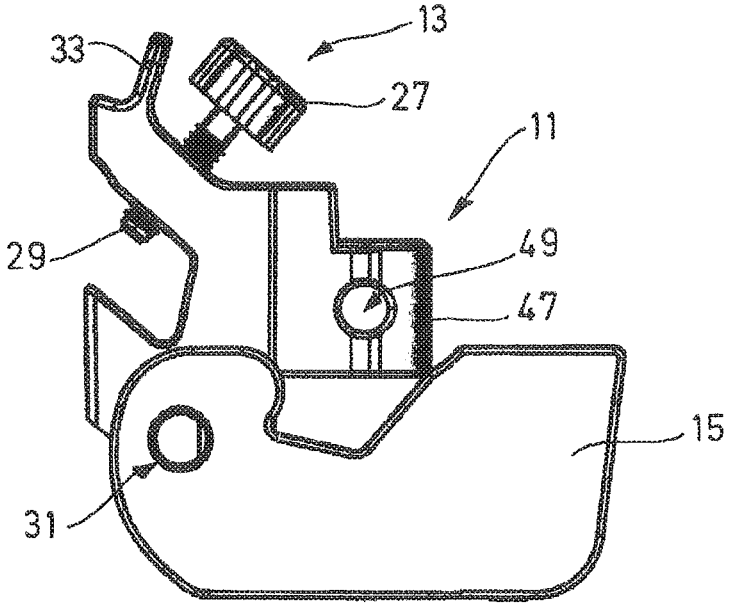
Figure 6:
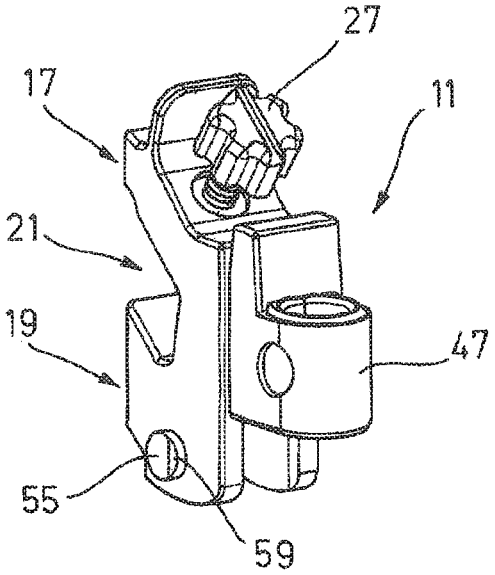
FIG. 6 the base body of FIG. 1 in a perspective single representation.

The power circuit breaker lockout apparatus 9 shown comprises a base body 11, a locking screw 13, and an at least substantially box-shaped cover 15 (cf. FIG. 1). The base body 11 has a first section 17, a second section 19, and a recess 21 formed between the first section 17 and the second section 19 (cf. FIG. 6). The base body 11 and the cover 15 are each formed in one piece and are manufactured by an in injection molding process. The power circuit breaker lockout apparatus 9 is shown in the Figures in a position of use in which the first section 17 of the base body 11 is upwardly oriented.

The power circuit breaker lockout apparatus 9 is fastenable to the toggle switch lever 23 of the power circuit breaker 25 via the recess 21 and by the locking screw 13 (cf. FIGS. 3 and 4). For this purpose, the toggle switch lever 23 is first received in the recess 21 of the base body 11 that in particular extends obliquely to the horizontal. The base body 11 is subsequently fixed to the toggle switch lever 23 by the locking screw 13 that is installed at the first section 17 of the base body 11. The locking screw 13 for this purpose has an actuation switch arranged above the first section 17 in the form of a manually actuable rotary button 27 and a threaded shaft 29 that is fixedly connected thereto and whose free end extends through the first section 17 into the recess 21. The locking screw 13 can be screwed in a direction further into the recess 21 by a corresponding rotation of the rotary button 27 to fix the power circuit breaker lockout apparatus 9 to the power circuit breaker 25. To remove the power circuit breaker lockout apparatus 9 from the power circuit breaker 25 again later, the locking screw 13 can again be unscrewed in the direction out of the recess 21 by an opposite rotation of the rotary button 27, whereby the fixing of the power circuit breaker lockout apparatus 9 is released again.

Figure 2:
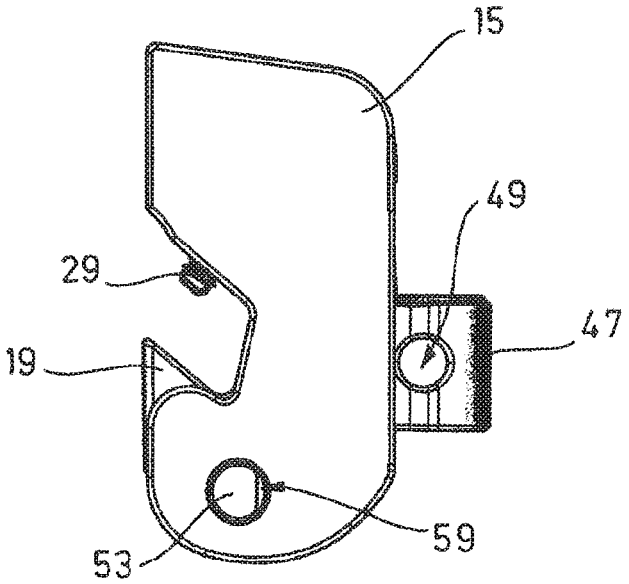
FIG. 2 the power circuit breaker lockout apparatus of FIG. 1, with the cover being in a lockout position.

The cover 15 is pivotably fastened to the first section 17 of the base body 11 via a pivot device 31. The cover 15 is here adjustable between a release position shown in FIG. 1 and a lockout position shown in FIG. 2. In the release position, the rotary button 27 of the locking screw 13 is accessible to a user. In the lockout position, in contrast, the rotary button 27 is covered by the cover 15 and access to the rotary button 27 is blocked for the user. The cover 15 can be fixed to the base body 11 in the lockout position by the padlocks 35, 37 shown in FIGS. 3 and 4, as will be explained in more detail below. It can hereby be prevented that the cover 15 is adjusted from the lockout position in accordance with FIG. 2 into the release position in accordance with FIG. 1 The rotary button 27 of the locking screw 13 is thus not accessible for an actuation, i.e. the power circuit breaker lockout apparatus 9 can no longer be removed from the power circuit breaker 25 so that the toggle switch lever 23 can also not be actuated and can in particular not be switched into its position switching on the electric circuit to be monitored.

Figure 7:
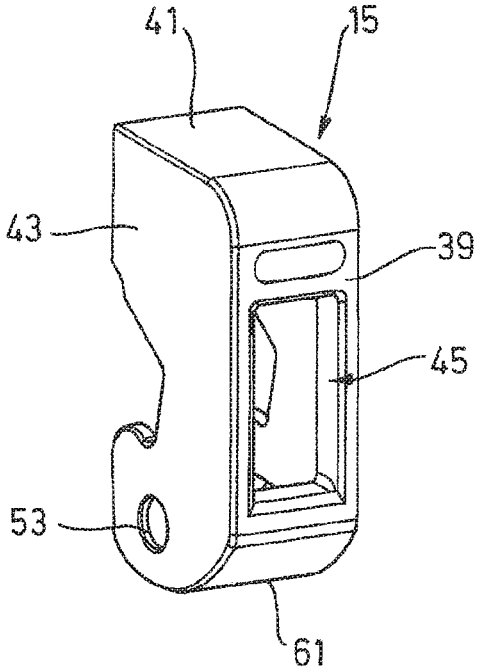
FIG. 7 the cover of FIG. 1 in a perspective single representation.

The cover 15 has a rear wall 39 that covers the side of the base body 11 disposed opposite the recess 21 in the lockout position, an end-face wall 41 that covers the first section 17 of the base body 11 in the lockout position, and two mutually oppositely disposed side walls 43 (cf. FIG. 7). The cover 15 furthermore also has a further end-face wall 61 disposed opposite the end-face wall 41. The blocking of access to the rotary button 27 by the cover 15 is supported in that the first section 17 has a blockade section 33 in the direction of the side of the recess 21 that counters an accessibility of the rotary button 27 from this direction.

Figure 5:
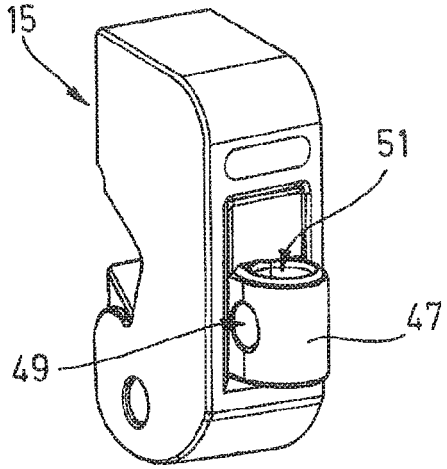
FIG. 5 the power circuit breaker lockout apparatus in accordance with FIG. 2 in a perspective view.
Figure 8:
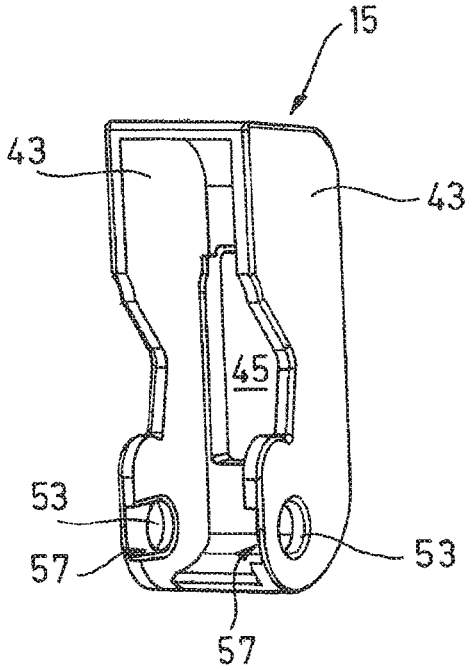
FIG. 8 the cover of FIG. 1 in a further perspective single representation.

A cutout, in particular a window-like cutout 45, (cf. FIGS. 7 and 8) is provided in the rear wall 39 of the cover 15 and a projection 47 (cf. FIGS. 5 and 6) that is formed at the side of the base body 11 disposed opposite the recess 21 extends through the cutout 45 in the lockout position of the cover 15 (cf. FIG. 5). At the outer cover side, a horizontal passage 49 having a first diameter and a vertical passage 51 having a second diameter that is comparatively larger than it are formed in the projection 47, the horizontal and vertical passages 49, 51 intersecting approximately at the center of the projection 47 and a respective hoop of the padlock 35 and 37 respectively being able to be led through them such that the cover 15 can be fixed to the base body 11 in its lockout position, i.e. is blockable against an adjustment into the release position.

Figure 9:
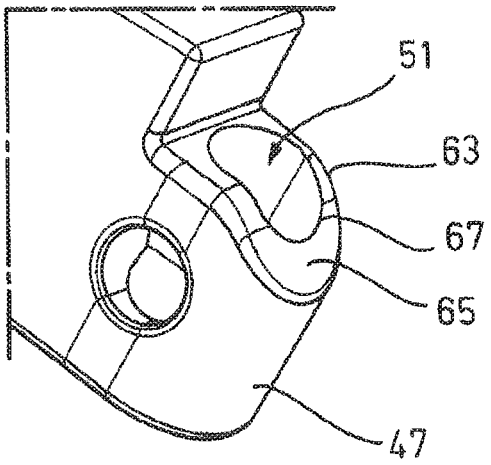
FIG. 9 an alternative embodiment of the projection of the base body of FIG. 1 in a perspective representation.

The projection 47 in accordance with FIG. 9 differs from the projection 47 described in connection with FIGS. 1 to 8 in that it has a chamfer 65 at its edge 63 that is configured at its upwardly directed end and at the side remote from the recess 21. The chamfer 65 is configured such that it extends up to and into the vertical passage 51 so that the plane formed by the opening margin 67 of the vertical passage 51 formed in this region is set obliquely toward the horizontal. The opening margin 67 therefore forms a rounded receiver in this region and has a vertical component into which a hoop of a padlock typically formed as a round hoop can be hung vertically in a defined position.

It generally applies that the projection 47 can be configured, in particular as shown in the Figures, as an eyelet or in the manner of an eyelet, in particular as a double eyelet, and/or in cylindrical form.

The pivot device 31 for the cover 15 to adjust the latter between the release position and the lockout position is formed in that a respective opening 53 is formed in the two side walls 43 of the cover 15 into which openings 53 two pins 55 engage that are formed at two mutually oppositely disposed lateral sides of the base body 11.

For the assembly of the base body 11 and the cover 15, the two side walls 43 are each provided at the inner side with a groove-like depression 57 that respectively extends between the respective opening 53 and a respective margin of the side wall 43 so that the respective pin 55 of the base body 11 can be pushed into the respective opening 53 of the respective side wall 43 to latch there. This is in particular also made possible in that the two side walls 43 of the cover 15 are formed as spring elastic so that they are pressed apart on the pushing of the cover 15 onto the base body 11. To facilitate the pressing apart, the two pins 55 each have a run-on slope 59 oriented in the direction of the respective groove-like depression 57.

REFERENCE NUMERAL LIST

9 circuit breaker lockout apparatus
11 base body
13 locking screw
15 cover
17 first section
17 second section
21 recess
23 toggle switch lever
25 power circuit breaker
27 rotary knob
29 threaded shaft
31 pivot device
33 blockade section
35 padlock
37 padlock
39 rear wall
41 end-face wall
43 side wall
45 cutout
47 projection
49 passage
51 passage
53 opening
55 pin
57 depression
59 run-up slope
61 end-face wall
63 edge
65 chamfer
67 opening margin

The invention claimed is:

1. A circuit breaker lockout apparatus, comprising a base body having a first section, a second section, and a recess formed between the first and second sections for receiving a switch lever of a circuit breaker;

a fixing element installed at the first section of the base body and having an actuation section to fix the base body to the switch lever of the circuit breaker received in the recess; and a cover adjustably fastened between a release position and a lockout position at the base body, wherein the actuation section of the fixing element is accessible in the release position and is covered in an inaccessible manner by the cover in the lockout position; and wherein the cover is configured to be fixed to the base body in the lockout position by a locking element to block an adjustment of the cover from the lockout position into the release position, wherein the base body includes a projection at a side disposed opposite the recess, the projection of the base body engaging through a cutout formed in the cover from an inner cover side to an outer cover side in the lockout position, with the projection being provided at the outer cover side with at least one passage through which the locking element may be led.

2. The circuit breaker lockout apparatus in accordance with claim 1, wherein the fixing element is a locking screw.

3. The circuit breaker lockout apparatus in accordance with claim 1, wherein the locking element is a hoop of a padlock.

4. The circuit breaker lockout apparatus in accordance with claim 1, wherein the at least one passage is oriented at least one of horizontally and vertically in a position of use of the circuit breaker lockout apparatus in which the first section of the base body is upwardly oriented.

5. The circuit breaker lockout apparatus in accordance with claim 1, wherein the at least one passage comprises a first passage and a second passage.

6. The circuit breaker lockout apparatus in accordance with claim 5, wherein the first passage and the second passage intersect.

7. The circuit breaker lockout apparatus in accordance with claim 5, wherein a diameter of the first passage is smaller than a diameter of the second passage.

8. The circuit breaker lockout apparatus in accordance with claim 4, wherein an edge of the projection formed at an end oriented upwardly in the position of use of the circuit breaker lockout apparatus and at a side remote from the recess has a chamfer that extends up to and into the vertically oriented passage such that, in a region of the chamfer, a section of an opening margin of the vertically oriented passage is formed that defines a plane that is inclined with respect to the horizontal.

9. The circuit breaker lockout apparatus in accordance with claim 1, wherein the first section of the base body has a blockade section that shields the actuation section of the fixing element against access from a recess side of the base body.

10. The circuit breaker lockout apparatus in accordance with claim 1, wherein the cover comprises at least one rear wall associated with the side of the base body disposed opposite the recess, an end face wall associated with the first section of the base body, and two mutually oppositely disposed side walls to cover the actuation section of the fixing element in an inaccessible manner in the lockout position.

11. The circuit breaker lockout apparatus in accordance with claim 10, wherein the cutout is provided in the rear wall of the cover.

12. The circuit breaker lockout apparatus in accordance with claim 1, wherein the cover is adjustable fastened to the base body by the cover being pivotably fastened via a pivot device to the base body between the release position and the lockout position.

13. The circuit breaker lockout apparatus in accordance with claim 12, wherein the cover is pivotably fastened via a pivot device to the second section of the base body.

14. The circuit breaker lockout apparatus in accordance with claim 12, wherein the pivot device comprises the cover having a respective opening in two mutually oppositely disposed side walls and the second section of the base body having a respective pin at two mutually oppositely disposed sides that engages into a respective one of the two openings.

15. The circuit breaker lockout apparatus in accordance with claim 14, wherein the respective pin is latched into the respective one of the two openings.

16. The circuit breaker lockout apparatus in accordance with claim 14, wherein the respective side wall of the cover has at its inner side a groove-like depression whose one end opens into the respective opening and whose other end extends up to a margin of the respective side wall to enable a pushing of the cover onto the base body on an assembly of the circuit breaker lockout apparatus.

17. The circuit breaker lockout apparatus in accordance with claim 16, wherein the other end of the groove-like depression enables a pushing in of the respective pin up to the respective opening.

18. The circuit breaker lockout apparatus in accordance with claim 14, wherein the two pins each have a run-on slope for the side walls of the cover to facilitate a pushing of the cover onto the base body.

19. The circuit breaker lockout apparatus in accordance with claim 14, wherein at least the two side walls of the cover are formed as spring elastic to enable a pressing apart of the two side walls on the pushing of the cover onto the base body.

20. The circuit breaker lockout apparatus in accordance with claim 1, wherein at least one of the base body and the cover is formed as at least one of an injection molded part and in one piece.

* * * * *